United States Patent [19]

Canavan

[11] 4,122,660

[45] Oct. 31, 1978

[54] SNOW ALARM

[76] Inventor: Richard J. Canavan, 46 Merton Ave., Lynbrook, N.Y. 11563

[21] Appl. No.: 805,093

[22] Filed: Jun. 9, 1977

[51] Int. Cl.[2] ..... G04B 23/06

[52] U.S. Cl. ..... 58/16.5; 58/19 R; 58/38 R; 58/152 B; 307/116; 340/539; 340/580

[58] Field of Search ..... 307/116, 118, 119; 58/16, 16.5, 19 R, 22.7, 23 R, 38 R, 57.5, 145 R, 152 R, 152 A, 152 B; 340/234, 235, 272

[56] References Cited

U.S. PATENT DOCUMENTS 1,369,427 2/1921 Hartley ..... 58/152 B 3,259,894 7/1966 Ciccarone ..... 340/234

3,801,779 4/1974 Ver Sluis ..... 250/222 R

*Primary Examiner*—Robert K. Schaeffer

*Assistant Examiner*—Vit W. Miska

*Attorney, Agent, or Firm*—Leonard H. King

[57] ABSTRACT

An alarm clock has associated with it an alarm and a snow-sensing means for detecting an accumulation of snow. The clock is provided with means for setting an alarm at two individually presettable times, one of which is set for normal waking and the other set in advance of the first to alert the sleeping user at a time earlier than the preset normal wakeup time when there has been an accumulation of snow while he slept.

7 Claims, 3 Drawing Figures

SNOW ALARM

FIELD OF THE INVENTION

This invention relates to an alarm system and, more particularly, to such a system that will awaken the user at his usual time under normal circumstances, and at another preset time in advance thereof when snow has accumulated during the period of sleep.

BACKGROUND OF THE INVENTION

Often when a person awakes on a winter morning, he is surprised to find that a significant snowfall has occurred while he slept. For the motorist, such a situation brings with it icy roads, slowed traffic conditions and the necessity of brushing snow from the car and shoveling walks and drives. For the non-motorist, an overnight snowfall means slippery walks that must be traversed slowly and with great caution. A person awakening at his usual time will be faced with slowed conditions and extra tasks to perform, and he will probably be quite late for his appointments.

To avoid this problem, the clock of this invention provides for two individually presettable alarm settings— one for "normal" conditions and a second for "snow" conditions. In this way, a person can be awakened at a time earlier than the "normal" preset waking time when a snowfall has occurred during the night.

SUMMARY OF THE INVENTION

The snow alarm system of this invention includes a clock having a time-keeping mechanism of a type well known in the art, but including two individually presettable and separately activated switchable alarm settings. One of the alarm switches, when activated at a predetermined "normal" waking time, sets off the alarm to awaken the sleeper. The second alarm switch, presettable to a time in advance of the "normal" waking time, is connected electrically in series with a snow detector of a type known in the art and the alarm. The snow detector is adapted to close a switch when a particular snowfall condition is sensed, thus setting off the alarm upon the concurrence of the sensed snowfall condition and the preset time of the "snow" wakeup alarm.

If, for example, the user of the disclosed invention would normally sleep until seven A.M., the "normal" wakeup alarm would be set for 7:00. If a snowfall condition of the nature and degree sensed by the snow detector would require an additional hour for shoveling of walks or drives, extra travel time, etc., the "snow" wakeup alarm would be set for 6:00. Thus, in the absence of snow, the alarm would sound at 7:00, with a sensed snowfall condition, it would sound at 6:00, to give the user a sufficient time to deal with the exigencies of the fallen snow.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings.

BRIEF DESCRIPTION OF THE DRAWINGS

Referring now to the FIGS. of the drawings, in which the reference characters designate like parts.

DETAILED DESCRIPTION OF THE PREFERRED EMBODIMENTS

Figure 2:
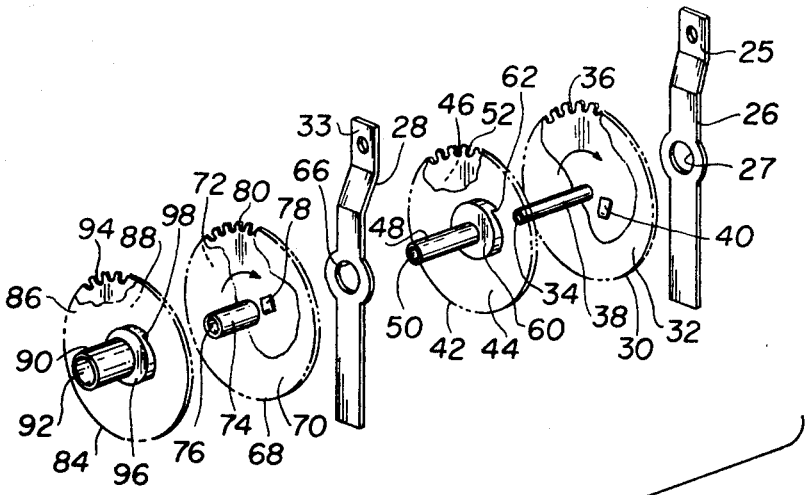
FIG. 2 is an exploded view of the actuating means of the invention.
Figure 1:
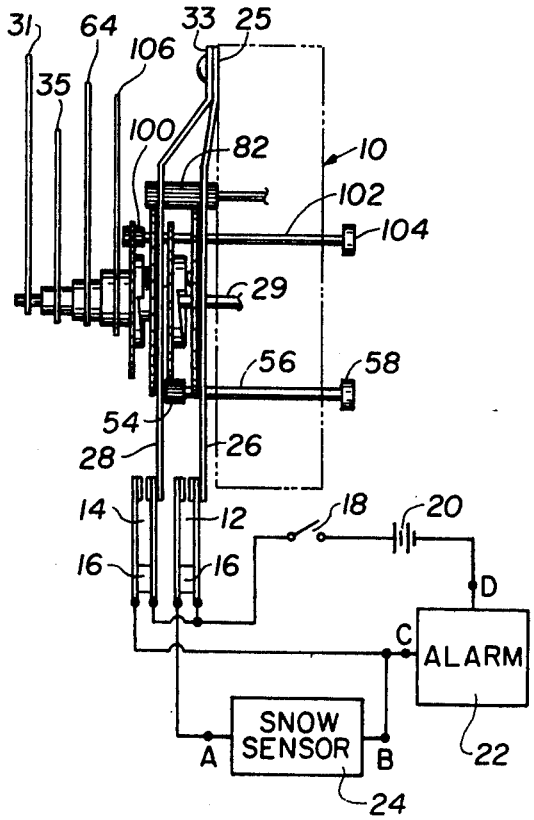
FIG. 1 is a schematic view of one embodiment of the snow alarm of this invention.

An embodiment of the snow-alarm system of this invention is shown in FIGS. 1 and 2. A clock, designated generally by the numeral 10 and having a mechanism well known in the art, is provided with two pairs of switch contacts forming switches 12 and 14, each having a spacing insulator 16 to maintain each switch in a normally open position. The first alarm switch 12 and second alarm switch 14 each have one contact connected through an alarm enabling switch 18 to one pole of a battery 20 or other source of potential. Alarm enabling switch 18 serves as an on-off switch for the alarm to permit the user to disable operation thereof. The opposite pole of battery 20 is connected to one contact, labeled point D, of an alarm 22, which may be an audio or visual indicator, a radio, or a relay or other switching means for actuating a separate device. The remaining contact of second alarm switch 14 is connected to the alarm 22 at point C. The remaining contact of first alarm switch 12 is connected to a snow sensing means 24 at point A and terminal B of the snow sensor 24 is connected to alarm 22 at point C. The snow sensing means 24 may comprise a simple conductive element or photocell arrangement, or one of the more complex devices disclosed in the art, such as, for example, that described in U.S. Pat. No. 3,259,894 to Ciccarone.

Upon detection of an accumulation of snow, snow sensor 24 closes a switch the contacts of which are connected, as depicted in FIG. 1, to points A and B. Thus, with switch 18 closed to enable operation of the alarm 22, the same will be set off when either second alarm switch 14 is closed, or when first alarm switch 12 is closed concurrently with the detection of an accumulation of snow by snow sensor 24.

The clock 10 is provided with a main shaft 29, which, at one end, rotatively carries a minute hand 31 for indication of time by its position relative to a conventionally marked clock face, not shown. Main shaft 29 is rotatively driven by a plurality of timing gears within the clock 10.

As depicted in greater detail in FIG. 2, a first switch actuator 26 has a centrally located opening 27 through which main shaft 29 passes. Actuator 26 is fixed against rotative movement about shaft 29, as, for example, by attachment at its end 25 to the clock frame as shown in FIG. 1. A first gear 30 is provided with a first sleeve 38 projecting normally from the plane of its frontal surface 32. First gear 30 is rotatable on and relative to main shaft 29, which passes through a longitudinal bore 34 of the first sleeve 38. First gear 30 has about its periphery gear teeth 36, which mesh with the teeth of timing gear 82, one of the plurality of timing gears in clock 10, in turn the first gear 30 about main shaft 29. A raised tooth 40 on the frontal surface 32 of first gear 30 rotates with the gear for a purpose to be described hereinafter. The direction of rotation of the first gear 30 is indicated by the arrow thereon in FIG. 2.

A second gear 42 is provided with a second sleeve 48 projecting normally from its frontal surface 44. A bore 50, longitudinally oriented through second sleeve 48, receives therethrough the sleeve 38 of first gear 30 to position the rear surface 46 of second gear 42 in facing adjacency to and substantially parallel with the frontal surface 32 of first gear 30. A cam 60 forms a raised annular surface upon and about the center of the rear surface 46 of second gear 42 concentrically about first sleeve 38. Tooth 40 is so located on first gear 30 so as to ride upon the surface of cam 60 of second gear 42 and, in so doing, to engage a detent 62 in the surface of cam 60 as the tooth 40 moves around the annular cam surface.

Second gear 42 is rotated about sleeve 38 and relative thereto through engagement with a shaft 56 having a toothed end 54, which toothed end 54 meshes with the teeth 52 of second gear 42. Shaft 56 is manually rotated by a finger nut or knob 58 at the opposite end of shaft 56 to turn second gear 42 to a selected position. A first pointer 64 mounted on the end of second sleeve 48 and positioned adjacent the clock face provides a visual indication of the relative rotative position of second gear 42 and, therefore, of detent 62 on the surface of cam 60, to indicate, in conjunction with the markings on the clock face, the time to which the snow condition-alarm has been preset for operation by switch 12.

A second switch actuator 28 has a centrally located opening 66 to receive therethrough the sleeve 48 of second gear 42. Second actuator 28, like first actuator 26, is fixed against rotative movement about sleeve 48, as, for example, by attachment of its end 33 to the clock frame as shown in FIG. 1, for contact with and operation of switch 14 in a manner to be described below.

A third gear 68 is provided with a third sleeve 74 extending normally from the frontal surface 70 of the gear. A longitudinal bore 76 in third sleeve 74 is sized to receive therethrough second sleeve 48 of second gear 42 to position the rear surface 72 of third gear 68 in facing adjacency to and parallel with the frontal surface 44 of second gear 42. Third gear 68 is rotated about and relative to second sleeve 48 through a meshing of its gear teeth 80 with the timing gear 82. Third gear 68 is also provided with a tooth 78 projecting outwardly from the frontal surface 70 and situated interior of the teeth 80 of third gear 68. An arrow on third gear 68 in FIG. 2 indicates its direction of rotation.

Advantageously, both first gear 30 and third gear 68 are rotated by the same timing gear 82, as shown in FIG. 1, each completing a single revolution for each full clock period. Thus, in a clock 10 having a twelve-hour cycle, first gear 30 and third gear 68 each complete a single revolution each 12 hours. Since the first gear 30 completely rotates only once for each twelve-hour period, a clock hour hand 35 may be conveniently fixed to the end of first sleeve 38, perpendicular thereto and adjacent the clock face for indicating the time by the position of the hour hand 35 in conjunction with the position of the minute hand 31, relative to the markings on the clock face.

A fourth gear 84 having gear teeth 94 about its peripheral edge is provided with a fourth sleeve 90 extending normally from the frontal surface 86 thereof. A bore 92 in fourth sleeve 90 is sized to receive therethrough the third sleeve 74 of third gear 68, thereby positioning the rear surface 88 of fourth gear 84 in facing adjacency to and parallel with frontal surface 70 of third gear 68. An annular cam 96 on the rear surface 88 is positioned concentric third sleeve 74 passing therethrough. Tooth 78 of rotating third gear 68 rides on the surface of cam 96 and engages a detent 98 therein to operate second switch 14 in a manner to be described hereinafter. Fourth gear 84 is manually rotatable about and relative to third sleeve 74 through engagement of its gear teeth 94 with a toothed end 100 of a shaft 102, the shaft 102 having at its other end a finger nut or knob 104 for manual rotation thereof. A second pointer 106 is mounted on the end of fourth sleeve 90 to indicate the relative position of fourth gear 84 and thereby indicate the preset time at which second switch 14 will be operated by second switch actuator 28 in a manner to be described hereinafter.

Thus, it may be seen that first gear 30, second gear 42, third gear 68 and fourth gear 84 are nested through a concentric arrangement of their sleeves 38, 48, 74 and 90, respectively. Each gear is individually rotatable relative to the others. First gear 30 and third gear 68 are turned in conjunction with timing gears within the clock 10 and, in particular, with timing gear 82, whereas second gear 42 and fourth gear 84 are individually manually rotatable to selected positions to preset times for snow condition and normal operation, respectively, of the alarm.

In operation, the normal alarm preset knob 104 is manually turned to rotate fourth gear 84 to a selected position, as indicated by the position of pointer 106 relative to the markings on the face of the clock. This rotation of fourth gear 84 moves with it cam 96 thereon, and detent 98 on the cam's surface, to a selected position relative to third gear 68 and fixed tooth 78 thereon. When third gear 68, moved by timing gear 82, reaches a position in its rotation where tooth 78 engages detent 98 in cam 96, second switch actuator 28, which may be conveniently formed of spring steel to exert a constant leftward force in FIGS. 1 and 2, forces third gear 68 leftward to drop tooth 78 into detent 98, thereby moving second switch actuator 28 against the contacts of switch 14 to close the same and set off the alarm 22. Pointer 106 is, therefore, set by manual rotation of the knob 104 for the normal waking time of the user, as indicated by its position relative to the markings on the face of the clock, and, if switch 18 is closed enabling the alarm, the same will be operated at the preset time as indicated by the pointer 106.

Pointer 64 is set with the snow alarm preset knob 58 to a position indicating a wake-up time earlier than that indicated by pointer 106, the interval between the two times being determined by the extra amount of time required by a sleeper awakening to an accumulation of snow. Setting pointer 64 simultaneously rotates second gear 42, and with it cam 60, to a position where tooth 40 on first gear 30 will, in the course of its rotation, engage detent 62 at a time corresponding to that indicated by the position of pointer 64 relative to the markings on the face of the clock. Upon engagement of tooth 40 with detent 62 of cam 60, the spring force of first switch actuator 26 will force first gear 30 to the left as tooth 40 moves leftward into detent 62 and thereby close the contacts of switch 12. Alarm 22 will be set off by the closing of contacts 12 only when snow sensing means 24 is simultaneously activated by an accumulation of snow. Thus, in the absence of such an accumulation, operation of the alarm 22 will be prevented at the earlier preset time as indicated by the position of pointer 64 and alarm operation will not occur until the later preset time as indicated by the position of pointer 106 on the face of the clock.

Figure 3:
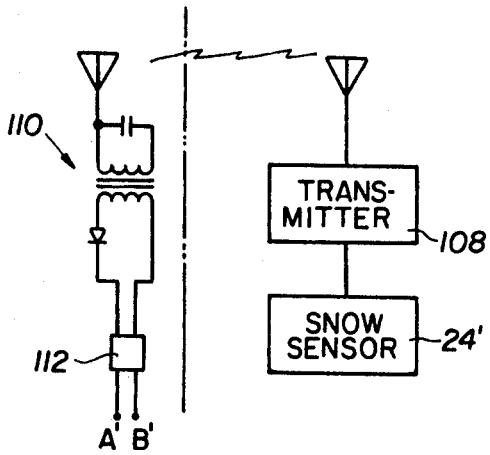
FIG. 3 is a schematic diagram of an alternate embodiment of the snow sensing transmission means of the invention.

FIG. 3 details an alternate embodiment of the snow alarm system of the present invention. In this embodiment, a snow sensor 24' at a remote location activates, upon detection of an accumulation of snow, a transmitter 108. The signal from the transmitter 108 is picked up by a receiver, designated generally by the numeral 110, which is situated within or reasonably close to the clock 10 and the alarm 22.

Receiver 110, the design of which is well known in the art, is adapted to energize, upon receipt of a signal from transmitter 108, a relay 112 having switched contacts labeled A' and B' in FIG. 3. Attaching points A' and B' to the points labeled A and B in FIG. 1, to replace snow sensor block 24 therein, will permit the use of the snow alarm system in a situation in which it is not feasible to run wires from the clock to the snow sensing means.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a clock having a main shaft, a clock face and hands for indicating the time, a plurality of timing gears connected with the shaft, means for presetting a time, a pointer adjacent the clock face for indicating the time preset, and an alarm associated with the clock and for alarm operation thereby when the preset time is reached, the invention comprising:

means associated with the clock for sensing an accumulation of snow, including first switchable means responsive to the detection by said snow sensing means of an accumulation of snow;

means on the clock for presetting a second time for alarm operation, whereby the second preset time may be earlier than the first preset time for alarm operation prior to the first preset time;

second switchable means on the clock and for actuation at the second preset time, said second switchable means being in series electrical connection with said first switchable means and the alarm; and means on the clock for actuating said second switchable means at the second preset time, whereby the alarm is operable at the second preset time when said first switchable means is actuated by said snow sensing means concurrently with the actuation of said second switchable means to awaken a sleeper at a time earlier than the first preset time when there has been an accumulation of snow during the period of sleep.

2. In the clock of claim 1, said actuating means comprising:

first gear means on the main shaft and rotatable thereon by the plurality of timing gears;

second gear means on the main shaft adjacent to and substantially parallel with said first gear means and rotatable on the main shaft to a selected position by said second presetting means;

cam means on said second gear means and having a cam surface and a detent in said cam surface;

a tooth on said first gear means and interior of the peripheral edge thereof engageable with the detent at the second preset time as said first gear is rotated relative to said selectably-positioned second gear; and an actuator for said second switch to actuate said second switchable means when said tooth engages the detent in said cam surface at the second preset time.

3. In the clock of claim 2, said second switchable means comprising a pair of normally open switch contacts.

4. In the clock of claim 2, said second presetting means including a second pointer on said second gear means for rotation therewith to a selected position relative to and acjacent the clock face for indicating the second time preset for alarm operation.

5. In the clock of claim 1, said snow sensing means including transmitting means, whereby detection by said snow sensing means of a snowfall condition initiates transmission of a signal, and receiving means to actuate said first switchable means when a signal from said transmitting means is detected thereby.

6. The clock of claim 5, wherein said transmitting and receiving means are radio means forming a wireless radio link to facilitate placement of said snow sensing means at a location remote from said first switchable means.

7. In a clock having a plurality of timing gears and for setting off an alarm at two individually presettable times, one of which is set for waking and the other set in advance thereof for earlier-than-usual waking in the event of an accumulation of snow, an alarm associated with the clock and for alarm operation thereby, a first alarm switch on the clock and connected with the alarm for operation of the same at a first preset time, means associated with the clock for sensing an accumulation of snow, a second alarm switch on the clock and connected in series with the alarm and the snow sensing means for operation of the alarm at a second preset time if the snow sensing means detects an accumulation of snow concurrently with the actuation of said second alarm switch, a clock shaft carrying a clock minute hand, an actuator for said second switch about said shaft and fixed against movement for actuation of said second alarm switch, a first gear rotatable on and relative to said shaft by the plurality of timing gears and having a frontal surface and a rear surface and a first sleeve projecting from the frontal surface and normal thereto to receive said shaft through said first sleeve, said actuator for said second switch being adjacent the rear surface of said first gear, a tooth on the frontal surface and interior of the peripheral edge of said first gear for rotation therewith, a clock hour hand carried by said first sleeve and rotatable therewith, a second gear having a frontal surface and a rear surface, and having a second sleeve projecting from its frontal surface and normal thereto for receiving therethrough said first sleeve to position the rear surface of said second gear in facing adjacency to and substantially parallel with the frontal surface of said first gear and rotatable relative thereto, a cam on the rear surface of said second gear, said cam being aligned to receive in riding relation thereon said first gear tooth and having a detent in the cam, a first pointer on said second sleeve to indicate a first preset time for setting off the alarm, means to rotate said second gear to a first preset time as indicated by the relative position of said first pointer, whereby engagement of said first gear tooth with the detent of said second gear cam at said first preset time moves said actuator for said second switch to actuate said second switch, setting off the alarm if said snow sensing means detects an accumulation of snow concurrently with the actuation of said second switch, an actuator for said first switch about said second sleeve and adjacent the frontal surface of said second gear, said actuator for said first switch being fixed against movement for actuation of said first alarm switch, a third gear having a frontal surface and a rear surface and having a third sleeve projecting from its frontal surface and normal thereto for receiving therethrough said second sleeve to position the rear surface of said third gear in facing adjacency to and substantially parallel with the frontal surface of said second gear and rotatable relative thereto by the plurality of timing gears, a tooth on the frontal surface and interior of the peripheral edge of said third gear for rotation therewith, a fourth gear having a frontal surface and a rear surface and having a fourth sleeve projecting from its frontal surface and normal thereto for receiving therethrough said third sleeve to position the rear surface of said fourth gear in facing adjacency to and substantially parallel with the frontal surface of said third gear and rotatable relative thereto, a cam on the rear surface of said fourth gear, said cam being aligned to receive in riding relation thereon said third gear tooth and having a detent in the cam, a second pointer on said fourth sleeve to indicate a second preset time for setting off the alarm, means to rotate said fourth gear to a selected position as indicated by the relative position of said second pointer, whereby when a second preset time is reached said third gear tooth engages the detent of said fourth gear cam to move said actuator for said second switch and actuate said second alarm switch to set off the alarm.

* * * * *